US007204111B2

(12) United States Patent
Inoue

(10) Patent No.: US 7,204,111 B2
(45) Date of Patent: Apr. 17, 2007

(54) LUBRICATED HOT ROLLING METHOD

(75) Inventor: Tsuyoshi Inoue, Chiba (JP)

(73) Assignees: Nippon Steel Corporation, Chiyoda-ku, Tokyo (JP); Arcelor France, St. Denis (FR)

( * ) Notice: Subject to any disclaimer, the term of this patent is extended or adjusted under 35 U.S.C. 154(b) by 0 days.

(21) Appl. No.: 10/559,496

(22) PCT Filed: Jun. 4, 2004

(86) PCT No.: PCT/JP2004/008152

§ 371 (c)(1),
(2), (4) Date: Mar. 6, 2006

(87) PCT Pub. No.: WO2004/108312

PCT Pub. Date: Dec. 16, 2004

(65) Prior Publication Data

US 2006/0156774 A1 Jul. 20, 2006

(30) Foreign Application Priority Data

Jun. 6, 2003 (JP) ..... 2003-162490

(51) Int. Cl.
*B21B 27/10* (2006.01)

(52) U.S. Cl. ..... 72/42; 72/45; 72/236

(58) Field of Classification Search ..... 72/420, 72/236, 39, 41, 42, 43, 44, 45, 200, 201
See application file for complete search history.

(56) References Cited

FOREIGN PATENT DOCUMENTS

| | | | |
|---|---|---|---|
| JP | 61063311 | | 4/1986 |
| JP | 61137613 | A * | 6/1986 |
| JP | 05000315 | A * | 1/1993 |
| JP | 05306397 | | 11/1993 |
| JP | 06079330 | | 3/1994 |
| JP | 06234989 | | 8/1994 |
| JP | 07003279 | | 1/1995 |
| JP | 08188789 | | 7/1996 |
| JP | 11279656 | | 10/1999 |
| JP | 11279657 | | 10/1999 |
| JP | 11293345 | | 10/1999 |
| JP | 2000312903 | | 11/2000 |
| JP | 2003094104 | | 4/2003 |

OTHER PUBLICATIONS

"Theory and Practice of Flat Rolling" *The Iron and Steel Institute of Japan* p. 218.

* cited by examiner

*Primary Examiner*—Dmitry Suhol
(74) *Attorney, Agent, or Firm*—Dorsey & Whitney LLP

(57) ABSTRACT

An exemplary lubricated hot rolling method is provided which can use a lubricating oil containing, e.g., one or more kinds among an high-basic alkaline-earth metal phenate, high-basic alkaline-earth metal carboxylate, high-basic alkaline-earth salicylate, or high-basic alkaline-earth metal sulfonate having a basicity of 40 mgKOH/g or higher, and has a viscosity at 40° C. of 800 cSt or less. The rolling can be performed by granulating or atomizing the lubricating oil into particulates whose average size is less than 1 mm, supplying the lubricating oil to rolls by using a noncombustible gas whose flow rate is 2000 $cm^3$ or more per minute per lubricating nozzle. The velocity of the oil may be 1 m or more per second. The amount supplied of the lubricating oil can be controlled to 0.01 $cm^3$ or more and 20 $cm^3$ or less per 1 $m^2$ of a surface area of the rolls.

2 Claims, 2 Drawing Sheets

LUBRICATED HOT ROLLING METHOD

CROSS REFERENCE TO RELATED APPLICATION(S)

This application is a national stage application of PCT Application No. PCT/JP2004/008152 which was filed on Jun. 4, 2004 and published on Dec. 15, 2004 as International Publication No. WO 2004/108312 (the "International Application"), the entire disclosure of which is incorporated herein by reference. This application claims priority from the International Application pursuant to 35 U.S.C. § 365. The present application also claims priority under 35 U.S.C. § 119 from Japanese Patent Application No. 2003-162490, filed Jun. 6, 2003, the entire disclosure of which is incorporated herein by reference.

FIELD OF THE INVENTION

The present invention generally relates to a hot rolling method using a lubricating oil in a hot rolling step of a steel manufacturing process. In particular, the present invention relates to a method to safely perform lubricated rolling by preventing fire accident which can occur by exposing a lubricant oil to a hot air atmosphere, in a lubricated hot rolling method using a lubricating oil containing an high-basic alkaline-earth metal compound, where rolling may be performed in a manner that the lubricating oil is granulated to particulates, blown out not necessarily by using water, and instead by a noncombustible gas, and provided to rolls adherently.

BACKGROUND INFORMATION

There may be various objects to perform the lubricated hot rolling, such as to lower frictional force during rolling, and thereby reducing roll abrasion so that an energy-saving effect is attained; to enhance the quality of the produce surface; and so forth. For example, a technique to control (by supplying a lubricating oil) a surface damage of an HSS roll (e.g., high speed steel roll), which has become pervasive as a roll material for hot rolling. For example, Japanese Patent Application Laid-open Nos. Hei 05-306397, 08-188789, 6-79330 and 7-3279 describe that when a lubricating oil containing an high-basic alkaline-earth metal phenate, an high-basic alkaline-earth metal carboxylate, an high-basic alkaline-earth metal salicylate, an high-basic alkaline-earth metal sulfonate, or the like whose basicities are 40 mgKOH/g or greater, can be emulsified by applying a water injection supplying method (e.g., may be presently prevailing method) to perform hot rolling, a sticking-prevention effect may be enhanced, and a controlling effect of peeling of the oxide film (mill scale) on the surface of the HSS roll regarded as a cause of rough surface can be attained.

Furthermore, in the hot rolling, a plate is thicker than in cold rolling, and a feeding device of a material may not be provided, so that bit slippage and rolling slippage may likely occur. There are known techniques to solve this problem. For example, it is known to operate by reducing the amount supplied of the lubricating oil when the operation is carried out under such conditions that can obtain a lubricating effect within a range of not causing a slippage accident. A known method can be utilized in which the lubricated rolling is not performed before and after the top portion of a rolled material is bit into a rolling mill and the bottom portion thereof comes off the rolling mill, so that bit slippage is prevented. On the other hand, Japanese Patent Application Laid-open No. Hei 06-234989 describes a technique which uses a lubricant whose self-friction coefficient is high so that bit slippage and the like do not occur even if the lubricated rolling is performed to the top and bottom portions of the steel.

"Theory and Practice of Flat Rolling", p. 218, The Iron and Steel Institute of Japan describes (as a lubrication supply method in hot rolling) a method in which a lubricating oil and vapor are blended and supplied in a spraying manner, other than the aforementioned method in which water and a lubricating oil are blended and supplied in a spraying manner in an emulsified form. On the other hand, Japanese Patent Application Laid-open Nos. Hei 11-279656, 11-279657 and 11-293345 describe (as a manufacturing method of hot rolling steel for deep drawing which is superior in uniformity of plate thickness) a technique outlined as that the amount supplied of a lubricating oil is 0.2 to 10 $cm^3$ per 1 $m^2$ of a surface area of the roll.

Further, Japanese Patent Application Laid-open No. 2003-94104 describes (as a lubricating oil supplying method not using water) a method to sprayedly supply to rolls the lubricating oil atomized or granulated to particulates using noncombustible gas, together with noncombustible gas. The supplying method can be known for: (i) providing a substantial friction-coefficient-reducing effect with a little amount supplied of the lubricating oil, (ii) reducing the friction force to the rolls, which reduces the roll abrasion, resulting in an effect of prolonging the life of the rolls; and (iii) providing a good resistance to disturbance since spraying of the noncombustible gas with the lubricating oil to the rolls allows the lubricating oil to reach the surface of the roll by blowing off the water film even if such water film formed by insufficient drying off of the roll cooling water exists on the surface of the roll.

When a lubricating oil being added with one kind or two or more kinds among the high-basic alkaline-earth metal phenate, high-basic alkaline-earth metal carboxylate, high-basic alkaline-earth metal salicylate, high-basic alkaline-earth metal sulfonate, and so forth, is used as an emulsified lubricant by being blended with water, the viscosity thereof may be higher than with conventional lubricating oils, so that nozzle clogging or pipe clogging is likely to occur. Accordingly, frequent cleaning of the pipe and nozzle may be required, which can lead to a deterioration of manufacturing efficiency. Further, in the case of the use of the emulsion-lubricated method, a dry-off wiper can be provided between a roll cooling water supplying section and a lubrication supplying section in order not to wet the lubrication supplying section with the roll cooling water. However, when the roll cooling water leaks into the lubrication supplying section through a clearance made by the rotation of the rolls and abrasion of the wiper, the lubricating oil supplied in the form of emulsified lubrication may become not easily adherable to the rolls. This can occur because the roll cooling water that leaks forms a water film over the surface of the roll, and further, the emulsion is blended with the cooling water so that its concentration (amount of the lubricating oil to water) is reduced, and the lubricating effect becomes difficult to be obtained.

It is known that approximately the same problem occurs with a supplying method in a steam-atomizing form. The concentration of the emulsified lubricant which is practically used is generally about 0.5 to 1.0 of lubricating oil to 100 of water in terms of ratio by weight. This range represents a range in which the slippage-accident prevention and the lubricating effect coexist. However, the concentration may be constantly changing by the dirt within the lubricant piping system, clogging of the nozzle, and further, a slight difference of viscosity of the lubricating oil by changing of temperature and humidity. A consequent problem that variation of lubricating effect occurs may also be recognized.

In order to solve these problems, if the method described in Japanese Patent Application Laid-open No. 2003-94104 is used, in which the lubricating oil is granulated into particulates and sprayed with the noncombustible gas to the rolls without using any water (hereinafter referred to as a gas atomizing method), a supply device with a very simple piping system can be formed. This may allow many of the above-described problems to be solved, and providing a firm resistance to external variable factors (such as, e.g., a seasonal change in viscosity or change in humidity). However, in this method, the lubricating oil itself can be directly supplied to the rolls near a steel material heated to approximately 800° C. to 1200° C., so that depending on the physicality and the usage environment of the lubricating oil, fire may break out in some instances. In particular, a lubricating oil being added with one kind or two or more kinds among the high-basic alkaline-earth metal phenate, high-basic alkaline-earth metal carboxylate, high-basic alkaline-earth salicylate, high-basic alkaline-earth metal sulfonate, and the like has a higher viscosity than lubricating oils not being added with them, so that when the lubricating oil is supplied in a manner described in Japanese Patent Application Laid-open No. 2003-94104, it is likely to scatter to or be deposited over the rolling mill facilities other than the rolls, causing a problem that the deposit flashes and sets a fire.

SUMMARY OF THE INVENTION

It is one of the objects of the present invention to provide a safe and stable lubricated hot rolling method not causing any fire accident, when a lubricating oil which is added with one kind or two or more kinds among high-basic alkaline-earth metal phenate, high-basic alkaline-earth metal carboxylate, high-basic alkaline-earth metal salicylate, high-basic alkaline-earth metal sulfonate, and the like, is supplied by, e.g., the gas atomizing method.

According to one exemplary embodiment of the present invention, it is possible to perform a safe and stable lubricated hot rolling while preventing fire from occurring even if a lubricating oil is supplied by the gas atomizing method in which the high-basic alkaline-earth metal compound of relatively high viscosity is blended, with the following exemplary conditions:

(i) the average particulate size of the lubricating oil is made to be less than 1 mm, (ii) the flow rate of the noncombustible gas (for example, air, helium, nitrogen, argon, or the like) sprayed concurrently with the lubricating oil in a form of particulates is made to be 2000 $cm^3$ or more per minute, (iii) the spraying speed of the gas is made to be 1 m or more per second, and (iv) the maximum amount of lubrication supply is made to be 20 $cm^3$ or less per 1 $m^2$ of the roll surface area.

For example, in order to prevent fire caused by the lubricating oil, scattering of the lubricating oil sprayed from the nozzle to areas other than the rolls should be prevented as much as possible, and 100% of the lubricating oil sprayed from the nozzle should adhere to the roll surface. This can be because that when the lubricating oil adherent to the roll surface is guided into the roll bite, the atmospheric gas is blocked so that the lubricating oil is carbonated while producing the lubricating effect without flaming up. The roll bite represents a region in a clearance between two rolls at which the rolls are directly in contact with a material to be rolled. However, in actual instances, it may be difficult for 100% of the lubricating oil sprayed from the nozzle to adhere to the roll surface. Indeed, some of the lubricating oil may adhere to the incidental facilities of the rolling mill provided around the rolls, for example, a water-drying wiper for the roll cooling water, roll-chock, inside of the housing of the rolling mill, guide, table roller, and so forth, because of the external elements such as the usage environment, in addition to the supplying method or supplying conditions of the lubricating oil.

The lubricating oil adherent to the facilities around the rolls can be deposited with increment of the lubrication supply time, and may form oil spots which drop to or are deposited on the plate path, or drop to the hot rolled steel which is in course of being rolled, causing fire. Further, from the surface of the steel being rolled, a high-temperature matter such as a scale may peel off and reach the lubricating oil adherent to and deposited on an incidental facilities of the rolling mill, generating a flame to cause fire. However, a large amount of roll cooling water may be generally supplied to the rolls, so that the water spots scatter to the facilities around the rolling mill as well. Accordingly, if a flame caused is to some extent small, any fire caused thereby can be extinguished without spreading. In addition, when an emulsified lubricant is used, water is sprayed with the lubricating oil concurrently, so that the concern about causing a fire accident does not exist unless the concentration of the lubricating oil is 70% by weight or more. On the other hand, when the lubricating oil is supplied by a gas atomizing method, such an effect cannot be expected, so that a particular measure may be preferable.

In view of the fire-accident-causing elements described above, the points to prevent fire accident can be:

attaching the lubricating oil sprayed from the nozzle to the surface of the rolls as much as possible;

taking such measures that does not easily cause igniting even if the lubricating oil adheres to a facility other than the rolls; and/or not allowing the lubricating oil sprayed from the nozzle to ignite while it reaches the rolls.

The conditions in order to realize these points in the gas atomizing supply method may be:

(i) the average particulate size of the lubricating oil is made to be less than 1 mm;

(ii) the flow rate of the noncombustible gas (for example, air, helium, nitrogen, argon, or the like) sprayed concurrently with the lubricating oil in a form of particulates is made to be 2000 $cm^3$ or more per minute;

(iii) the spraying speed of the gas is made to be 1 m or higher per second; and/or (iv) the maximum amount of lubrication supply is made to be 20 $cm^3$ or less per 1 $m^2$ of the roll surface area.

The lubricating oil can be granulated into particulates having a size less than 1 mm, because lightening the weight of the lubricating oil drop allows most of the lubricating oil sprayed from the nozzle to reach the rolls by the airflow of the noncombustible gas. If a lubricating oil whose particulates have a size of 1 mm or more is sprayed, the lubricating oil, particularly that sprayed from the lubricating nozzle for the upper roll, may become easily droppable to the steel material, igniting by the heat of the steel material, and leading to likelihood of flashing of the oil adherent to the surface of the facilities provided near an edge portion of the steel material. If the particulate size is less than 1 mm, e.g., virtually no lubricating oil drops from the nozzle, and even if it ignites, its volume is small enough that it immediately burns out, and does not spread to other parts.

If the average particulate size is more than 5 mm, the lubricating oil adherent to the rolls becomes easily droppable because of its own weight. Further, the lubricating oil adherent to the rolls tends to spread in the direction of the length of the roll before guided to the roll bite, much of which extends along the surface of the rolls other than the plate path and drops down, so that likelihood of ignition becomes high. The method of granulating the lubricating oil to particulates can be any method, e.g., a spraying method, or a method in which a mesh is passed through to make particulates. In addition, supplying by granulating or atomizing the lubricating oil into particulates secures supplying of a smaller amount in a spraying manner. It may be preferable to supply the lubricating oil by granulating or atomizing it into a size of 0.05 mm to less than 1 mm.

For example, the flow rate of the noncombustible gas sprayed concurrently with the lubricating oil can be set to 2000 $cm^3$ or greater per minute because the high gas flow rate creates a shield of the noncombustible gas around a particulate of the lubricating oil, so that ignition before the sprayed lubricating oil adheres to the rolls does not easily occur. Further, if the sprayed lubricating oil flushes off around the rolls, a supply of a large amount of noncombustible gas can create gas flows around the surface of the rolls and the circumference thereof, so that there is an effect of blowing off a flame caused near the rolls. A flow rate of the noncombustible gas of less than 2000 $cm^3$ per minute is insufficient to attain such an effect. Incidentally, unless a noncombustible gas of 1000 $cm^3$ or more per minute is sprayed, it can be difficult to remove a normally assumed amount of water film present over the surface of the rolls and attach the lubricating oil to the rolls.

By making the flow velocity of the noncombustible gas 1 m or higher per second, the speed of the lubricating oil sprayed from the nozzle is made high, and the time from spraying the lubricating oil out of the nozzle up to reaching thereof to the rolls can be shortened. This substantially enhances the effect of preventing the sprayed lubricating oil from scattering to somewhere other than the roll surface. By increasing the flow rate while leaving the flow velocity to less than 1 m per second encourages additional scattering of the lubricating oil in the form of particulates to somewhere other than the rolls. Unless both the flow rate and flow velocity are appropriately set out, the phenomenon that the lubricating oil scatters and is deposited on facilities other than the roll surface may occur frequently. In addition, if the gas flow velocity is higher, the effect of blowing out the flame which has ignited near the rolls can be enhanced. Both the gas flow rate and the gas flow velocity being made high can be very effective in preventing the flame from being created and in extinguishing a flame caused, and forms an important element of the present invention.

If the maximum amount supplied of the lubricating oil exceeds 20 $cm^3$ per 1 $m^2$ of the area of the roll surface, the lubricating effect is improved, but the supply becomes excessive, and in some instances leads to the lubricating oil spilling out of the plate path, blown out of the rolls with the centrifugal force by the rolling of the rolls, and scattering to and being deposited on the facilities around the rolls. This can become the origin of the fire, leading to higher probability of occurrence of fire accident. In the amount of 20 $cm^3$ or less, most of the lubricating oil sprayed to the rolls is guided into the roll bite, consumed by the friction between the rolls and the steel material, so that it does not turn into the origin of the fire. In addition, with an amount of the lubricating oil of 0.01 $cm^3$ or more per 1 $m^2$, a bit slippage can be prevented. Further, if the amount supplied of the lubricating oil is more than 30 $cm^3$ per 1 $m^2$ of the roll surface area, the rolling slippage occurs under any rolling condition, so that the amount supplied should be that volume or less. Thus, an amount supplied exceeding 30 $cm^3$ per 1 $m^2$ of the roll surface area can cause a fire accident, and it may be difficult to safely perform hot rolling. If the operation is performed preferably with the amount of the lubricating oil to be supplied being in a range of 0.1 $cm^3$ to 15 $cm^3$ per 1 $m^2$ of the roll surface area, it may be effective from the aspect of lubricity, economical efficiency, and safety.

According to an exemplary embodiment of the present invention, when a lubricating oil being added with one kind or two or more kinds among the high-basic alkaline-earth metal phenate, high-basic alkaline-earth metal carboxylate, high-basic alkaline-earth salicylate, or high-basic alkaline-earth metal sulfonate is supplied by the gas atomizing method to perform lubricated rolling, it generally does not cause bit slippage, rolling slippage, and the like, while a lubricating effect of the same or higher level compared to conventional lubrication supply methods can be brought out, and at the same time a safe and stable lubricated rolling can be performed without causing fire.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figure showing illustrative embodiments, results and/or features of the exemplary embodiment(s) of the present invention, in which.

DETAILED DESCRIPTION

Figure 1:
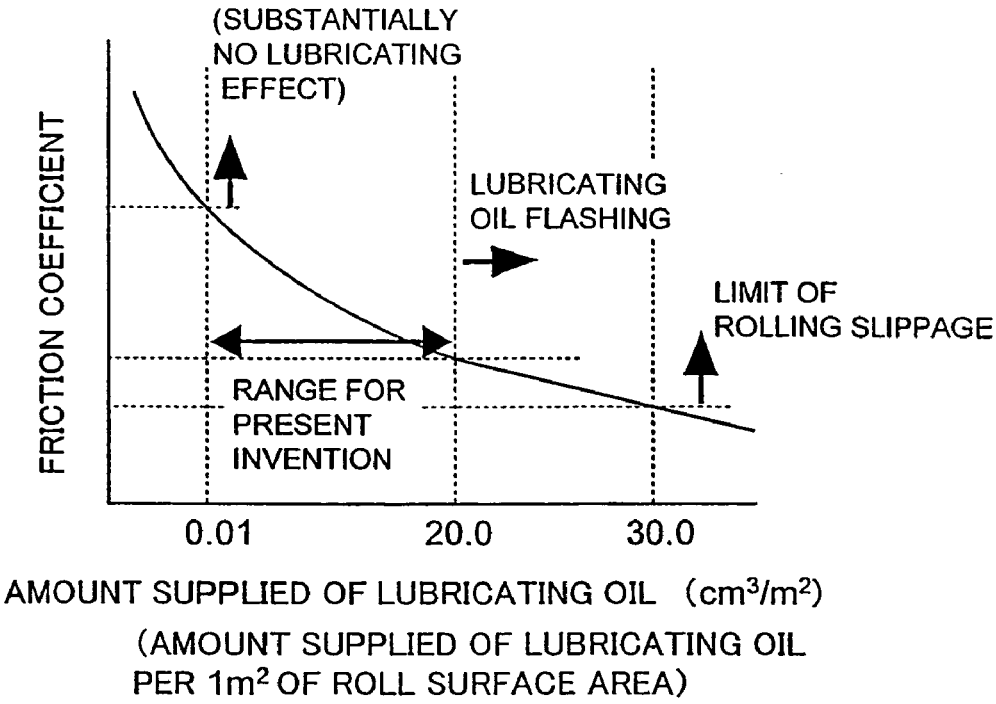
FIG. 1 is a chart illustrating an exemplary correlation of a marginal level of slippage occurrence and a range of occurrence of fire caused by a lubricating oil, with an amount supplied of the lubricating oil.

Examplary embodiments of a lubricated hot rolling according to the present invention are described below.

For example, a lubricating oil which contains 15 vol % of calcium sulfonate having a basicity of 300 mgKOH/g and has a viscosity at 40° C. of 170 cSt can be prepared. As a lubricating oil supplying nozzle, an air-atomizing nozzle is used, and the lubricating oil and a noncombustible gas are supplied to the rolls in a manner the both are sprayed in a common nozzle. Needless to say, the lubricating oil and the noncombustible gas may be supplied in a manner of being sprayed from separate nozzles. Before a material is bit into a particular rolling mill, the lubricating oil is sprayed to the rolls, with the amount of lubricating oil supplied of 0.7 $cm^3$ or less per 1 $m^2$ of the roll surface area per nozzle, under such conditions that a nitrogen gas as the noncombustible gas has a gas flow rate of 2200 $cm^3$ per minute and a gas flow velocity of 2.5 m/sec and that an average size of particulates of the lubricating oil is 0.8 mm, by a gas atomizing supply method. After the steel material to be rolled is bit into the rolling mill, a nitrogen gas in the amount of 3000 $cm^3$ per minute is sprayed at a flow velocity of 3 m per second, and the above-described lubricating oil is continuously supplied to the rolls with the particulate size thereof remaining the same, by the gas atomizing method.

Depending on changes in the rolling speed, the rolling is performed by adjusting the amount of the lubricating oil supplied in a spraying manner to be 0.01 $cm^3$ to 20 $cm^3$ or less for 1 $m^2$ of the roll surface area. Thus, as long as the amount supplied of the lubricating oil is 0.01 $cm^3$ to 20 $cm^3$ or less per 1 $m^2$ of the roll surface, based on an assumption that controlling is performed within that range, the rolling can be performed while adjustment is made in a manner that the rolling load and friction coefficient remain constant. Unless the amount supplied of the lubricating oil is increased according to the rolling speed increment, the lubricant oil goes short so that an expected lubricating effect may not be attained. Further, if the amount supplied of the lubricating oil exceeds 20 $cm^3$ per 1 $m^2$ of the roll surface area, a trouble such as breaking of fire occurs, so that the amount supplied of the lubricating oil should be kept within the range between 0.01 $cm^3$ to 20 $cm^3$ or less per 1 $m^2$ of the roll surface area. Thereafter, the lubrication supply is continued until immediately before the material passes through the rolling mill. When the material is completing passing through the rolling mill, the amount supplied of the lubricating oil is preferably set to 1 $cm^3$ or less per 1 $m^2$ of the roll surface area when the length of the material to be rolled becomes around five times of the peripheral length of the roll. In this manner, biting (e.g., passing through) of a following material is smoothed and the bit slippage is not caused.

FIRST EXEMPLARY EMBODIMENT

A controlling effect of generation of a mill scale of rolls according to the present invention is reviewed, and and a determination is made as to whether flashing phenomenon occurs or not during experiments, e.g., by using a hot rolling friction testing machine.

<Experimental Conditions>

- Experimental piece: diameter 80 mm, width 10 mm, made of an HSS roll material
- Counterpart piece: diameter 165 mm, width 15 mm, made of S45C
- Load: 30 kgf
- Rotational speed of experimental piece: 176 m/min
- Speed of counterpart piece: 185 m/min
- Temperature of friction surface of experimental piece: 650° C.
- Temperature of friction surface of counterpart piece: 880° C.

Exemplary Lubricating Oil:

(a) A lubricating oil in which 15 vol % of calcium sulfonate having a basicity of 300 mgKOH/g is blended in a mineral oil, and whose viscosity at 40° C. is 110 cSt.

(b) A lubricating oil in which 15 vol % of a colza oil is blended in a mineral oil and whose viscosity at 40° C. is 112 cSt (prepared for comparison).

Exemplary Supply Method:

(i) A gas atomizing method. The amount supplied can be approximately 3 $cm^3/m^2$, and used as gas was nitrogen. The gas flow rate can be provided in two levels which may be 1000 $cm^3$/min and 2500 $cm^3$/min, and an average particulate size of the lubricating oil was approximately 200 micron. The flow velocity may be 3 m per second.

(ii) Supplied as a 0.8% emulsion (the lubricating oil content is supplied at 3.2 $cm^3/m^2$).

Rolling friction time period: 10 minutes

<Experimental Result>

- Lubricating oil "(a)" and supply method "(i)" (a flow rate of 1000 $cm^3$/min)→Thickness of the mill scale:2 μm or less, ignition occurred at a part of the experimental piece.
- Lubricating oil "(a)" and supply method "(i)" (a flow rate of 2500 $cm^3$/min)→Thickness of the mill scale: 2 μm or less, no ignition occurred.
- Lubricating oil "(a)" and supply method "(ii)" →Thickness of the mill scale: about 3 μm, no ignition phenomenon occurred.
- Lubricating oil "(b)" and supply method "(i)" (a flow rate of 1000 $cm^3$/min)→Thickness of the mill scale: about 8 μm, an ignition phenomenon occurred.
- Lubricating oil "(b)" and supply method "(i)" (a flow rate of 2500 $cm^3$/min)→Thickness of the mill scale: about 8 μm, no ignition phenomenon occurred.
- Lubricating oil "(b)" and supply method "(ii)" →Thickness of the mill scale: about 9 μm, no ignition phenomenon occurred.

When the lubricated rolling method according to the exemplary embodiment of the present invention is used, the thickness of the mill scale formed on the surface of the experimental piece made of an HSS roll material was 2 μm or less, and further, fire did not occur around the experimental piece or a lubricant supply section during the experiment. However, in the same gas atomizing supply method, under the condition of a lower flow rate of the noncombustible gas, an ignition phenomenon by deposition of the lubricating oil on a part of the counterpart piece steel material was observed. This may be because the shielding effect and blowing-off effect by the noncombustible gas were not sufficient. Since the thickness of the mill scale is approximately 3 μm when the same lubricating oil was supplied by the conventional water injection method, it is verified that the lubricating effect of the same level as with the conventional method or higher could be attained by the present invention, and it was confirmed that the conditions under which fire does not occur when the lubricating oil is directly supplied can be formed.

SECOND EXEMPLARY EMBODIMENT

It is possible to use a 2Hi rolling mill (2-high mill) to examine a lowering effect of friction coefficient serving as a representative indicator of the lubricating performance when the lubricating-oil-supplying conditions were changed, and at the same time examined, by a rolling experiment, a marginal condition of occurrence of ignition. In this exemplary experiment, base conditions in accordance with the exemplary embodiment of the present invention with respect to four kinds of supply conditions were provided, and on the basis thereof, a lowering effect of the friction coefficient and occurrence of an ignition phenomenon were investigated by changing each condition of the four kinds of conditions separately.

<Experimental Conditions>

Roll: diameter 400 mm, HSS roll, roll length 100 mm

Material to be rolled: 0.02% carbon steel, thickness 1 mm×width 50 mm×length 1000 m (coil)

Heating temperature: 1000° C. (nitrogen atmosphere)

Rolling speed: 50 m/min

Roll gap: 20% to 40% in terms of draft ratio

Lubricating oil: a lubricating oil in which 25 vol % of calcium sulfonate having a basicity of 300 mgKOH/g is blended in a mineral oil, and whose viscosity at 40° C. is 110 cSt.

Supply conditions: supply by a spray nozzle. Used as the noncombustible gas was nitrogen.

(a) Amount supplied: 0.05 to 30 $cm^3/m^2$ (base condition: 2.5 $cm^3/m^2$)

(b) Flow rate of gas: 200 $cm^3$/min to 10000 $cm^3$/min (base condition: 3000 $cm^3$/min)

(c) Flow velocity of gas: 0.2 m per second to 10 m per second (base condition: 2 m per second)

(d) Average size of particulates of lubricating oil: 0.02 mm to 3 mm (base condition: 0.8 mm)

<Experiment Result>

A rolling experiment was performed by varying the supply condition "(a)" while the conditions "(b)", "(c)", and "(d)" equaled the respective base conditions thereof. FIG. 1 shows a friction coefficient lowering effect and a range of occurrence of the ignition phenomena during the experiment, when the amount supplied of the lubricating oil was changed. As shown in FIG. 1, the ignition of the supplied lubricating oil was observed when the amount supplied exceeded 20 $cm^3/m^2$, but within the range of the conditions of the present invention, the supplied lubricating oil did not ignite by being rolled while lubrication was supplied during the hot rolling, and rolling was performed without causing a slippage accident. The amount supplied of 30 $cm^3/m^2$ or more caused a rolling slippage, in which case rolling could not be performed. It was also confirmed that the lubricating effect of at least the same level as conventionally obtained or higher could be obtained.

Figure 2:
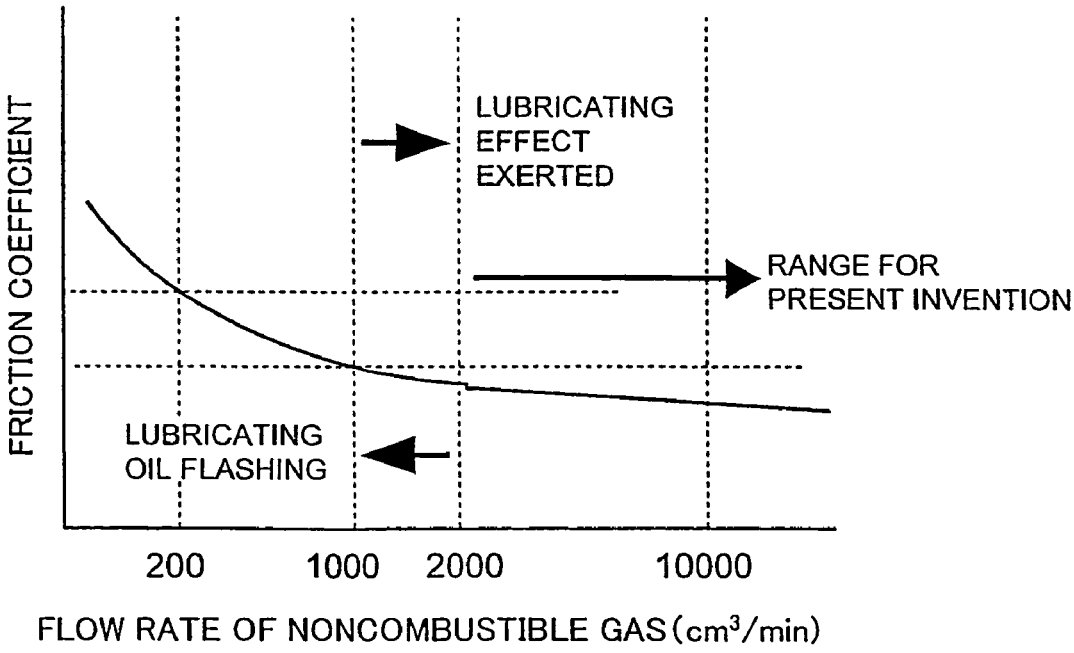
FIG. 2 is a chart illustrating an exemplary correlation between the range of occurrence of fire caused by a lubricating oil and flow rates of a noncombustible gas.

A continuous hot rolling of approximately 20 minutes was performed, by changing the flow rate of the gas in the supply condition "b" while the remaining supply conditions equaled the respective base conditions thereof. FIG. 2 shows a friction coefficient lowering effect and a range of the occurrence of the ignition phenomena during the experiment, when the amount supplied of the noncombustible gas (a nitrogen gas in this instance) was changed. As shown in FIG. 2, a lubricating effect was exerted with the gas flow rate of 1000 $cm^3$/min or higher, while it was observed that the supplied lubricating oil with a gas flow rate of less than 2000 $cm^3$/min caused an ignition phenomenon. Accordingly, the gas flow rate should be set to 2000 $cm^3$ or higher per minute in order to bring out the lubricating effect while preventing the ignition of the lubricating oil. It was also confirmed that a lubricating effect of at least the same level as conventionally attained or higher could be obtained.

Figure 3:
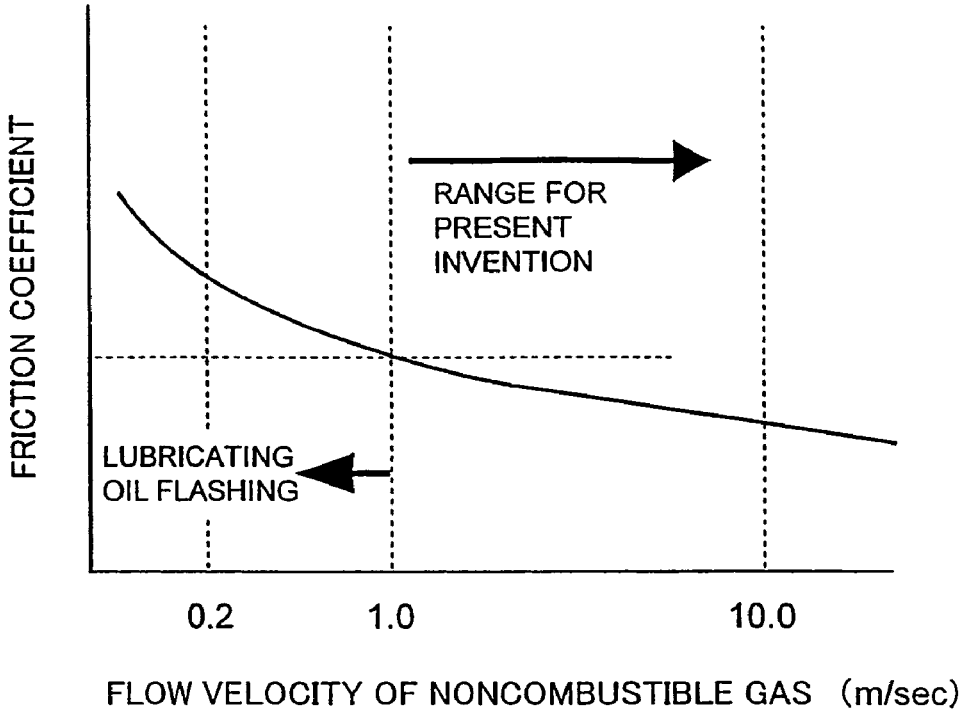
FIG. 3 is a chart illustrating an exemplary correlation between the range of occurrence of fire caused by a lubricating oil and flow velocities of a noncombustible gas.

A rolling experiment was performed by changing the gas flow velocity of the supply condition "(c)", while the remaining supply conditions equaled base conditions each thereof. FIG. 3 shows a friction coefficient lowering effect and a range of occurrence of ignition phenomena during the experiment when the gas flow velocity was changed. As shown in FIG. 3, when the gas flow velocity was less than 1 m/sec, phenomena of ignition of the lubricating oil were frequently observed during the lubricated rolling. However, supplying by setting the gas flow velocity to 1 m/sec or higher allowed the lubricated rolling without causing the ignition of the lubricating oil. It was also observed that the lubricating effect of at least the same level as conventionally attained or higher could be obtained.

Figure 4:
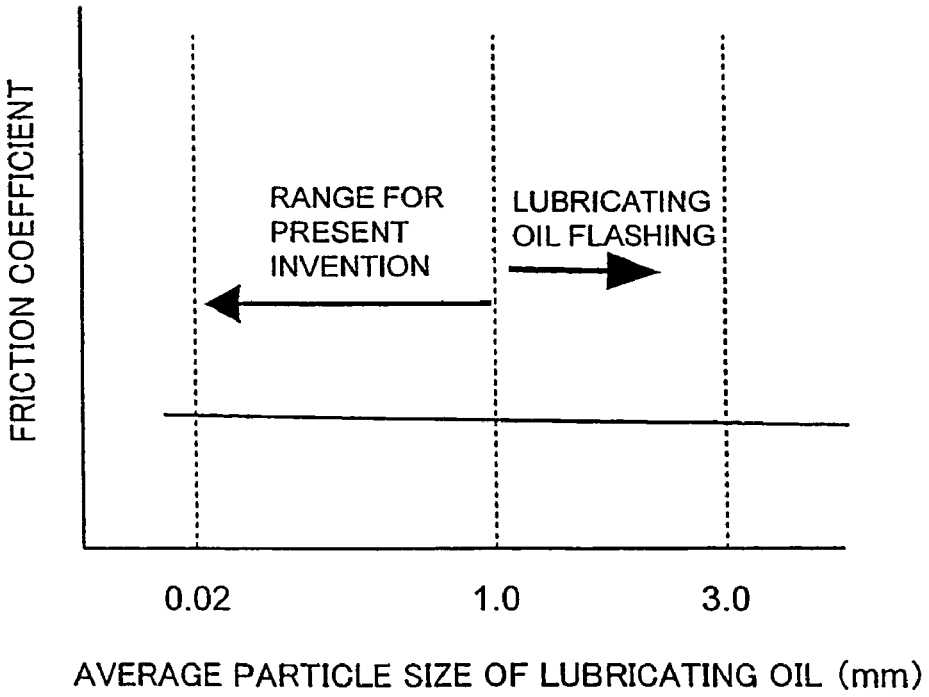
FIG. 4 is a chart illustrating an exemplary correlation between the range of occurrence of fire caused by a lubricating oil and average sizes of particulates of the lubricating oil.

A rolling experiment was performed by changing the average size of particulates of the lubricating oil in the supply condition "(d)". FIG. 4 shows a friction coefficient lowering effect and a range of occurrence of ignition phenomena during the experiment when the average particulate size of the lubricating oil was changed. As shown in FIG. 4, when the average particulate size was 1 mm or larger, occasional ignitions were observed during the lubricated rolling. However, when the average particulate size was made below 1 mm, no ignition phenomena were observed in performing lubricated rolling. It was also confirmed that the lubricating effect of at least the same level as conventionally attained or higher could be obtained.

INDUSTRIAL APPLICABILITY

According to the present invention, if a lubricating oil being added with one kind or two or more kinds among the high-basic alkaline-earth metal phenate, high-basic alkaline-earth metal carboxylate, high-basic alkaline-earth salicylate, or high-basic alkaline-earth metal sulfonate is supplied by a gas atomizing method to perform lubricated rolling, it does not cause bit slippage, rolling slippage, and the like. Further, a lubricating effect of at least the same or higher level compared to conventional lubrication supply methods can be brought out. Furthermore, a safe and stable lubricated rolling can be performed without causing fire.

The foregoing merely illustrates the principles of the invention. Various modifications and alterations to the described embodiments will be apparent to those skilled in the art in view of the teachings herein. It will thus be appreciated that those skilled in the art will be able to devise numerous modification to the exemplary embodiments of the present invention which, although not explicitly shown or described herein, embody the principles of the invention and are thus within the spirit and scope of the invention. All publications, applications and patents cited above are incorporated herein by reference in their entireties.

What is claimed is:

1. A lubricated hot rolling method that uses a lubricating oil which contains at least one of an high-basic alkaline-earth metal phenate, high-basic alkaline-earth metal carboxylate, high-basic alkaline-earth salicylate, or high-basic alkaline-earth metal sulfonate having a basicity of 40 mgKOH/g or higher, wherein the lubricating oil has a viscosity at approximately 40° C. of 800 cSt or less, the method comprising:

when a material to be rolled is supplied between at least two rolls, providing the lubricating oil to the rolls using a noncombustible gas, wherein, after the lubricating oil is granulated or atomized into particulates having an average size of approximately at most 1 mm, the noncombustible gas has a flow rate for at least one lubricating nozzle of approximately at least 2000 $cm^3$ per minute, and a flow velocity of at least 1 m per second in at least 0.01 $cm^3$ and at most 20 $cm^3$ per 1 $m^2$ of a surface area of the roll.

2. The lubricated hot rolling method according to claim 1, further comprising providing at least advance supply of the lubricating oil before the material to be rolled is bit between the rolls, and an amount supplied of the lubricating oil is approximately at most 1 $cm^3$ per 1 $m^2$ of the surface area of the rolls.

* * * * *